United States Patent [19]

Gestetner

[11] Patent Number: 4,544,298

[45] Date of Patent: Oct. 1, 1985

[54] HOLDING ELEMENT FOR SHEETS OF PAPER AND SIMILAR MATERIALS

[76] Inventor: David G. Gestetner, 952 Antonine Maillet, Qutremont, Montreal, Quebec, Canada, H2V 2Y9

[21] Appl. No.: 542,610

[22] Filed: Oct. 17, 1983

[30] Foreign Application Priority Data

Aug. 3, 1983 [CA] Canada ..... 433732

[51] Int. Cl.[4] ..... B42F 3/00; B42F 13/02; B42F 13/00

[52] U.S. Cl. ..... 402/19; 402/13; 402/73

[58] Field of Search ..... 402/13, 14, 15, 19, 402/22, 73, 74, 17, 77; 281/29, 35; 283/64

[56] References Cited

U.S. PATENT DOCUMENTS

| | | | |
|---|---|---|---|
| 2,289,949 | 7/1942 | Wisdom | 402/73 |
| 4,121,892 | 10/1978 | Nes | 402/17 |
| 4,174,909 | 11/1979 | Jahn | 402/13 |
| 4,192,620 | 3/1980 | Jahn | 402/15 |
| 4,256,411 | 3/1981 | Podosek | 402/73 |
| 4,261,664 | 4/1981 | Crawford | 402/13 |
| 4,397,577 | 8/1983 | Bauer | 402/19 |

FOREIGN PATENT DOCUMENTS

| | | | |
|---|---|---|---|
| 42562 | 8/1977 | Canada | 402/73 |
| 1536697 | 4/1970 | Fed. Rep. of Germany | 402/14 |
| 59816 | 5/1958 | India | 402/19 |
| 12140 | of 1913 | United Kingdom | 402/14 |
| 571013 | 8/1945 | United Kingdom | 402/19 |

*Primary Examiner*—Paul A. Bell
*Assistant Examiner*—Paul M. Heyrana, Sr.
*Attorney, Agent, or Firm*—Cushman, Darby & Cushman

[57] ABSTRACT

The invention is a holder for cheques and similar items, the holder being of unitary plastic construction with a pair of prong-like members being cut from a backing. The prong-like members of the holder in one form of the invention each have a stem portion and an enlarged outer end, the enlarged outer ends being adapted to pass through apertures in a series of sheets to hold those sheets on the backing. In a second form, the holder is formed from a plastic sufficiently resilient that the prong-like members attempt to return to the plane of the backing after being extended out of that plane. In this form of the invention, the pair of prong-like members are cut from the backing such that they are both directed generally toward each other. The pair of prong-like members can be extended through a pair of apertures in a series of sheets when the backing is flexed. After such flexing, the prong-like members attempt to return to the plane of the backing and in so doing act to hold the sheets against the backing. In a third form, the pair of prong-like members are cut from the backing such that they are directed generally away from each other. As with the second form, the prong-like members attempt to return to the plane of the backing after being biased to extend out of that plane for receiving a series of sheets.

6 Claims, 4 Drawing Figures

FIG. 1
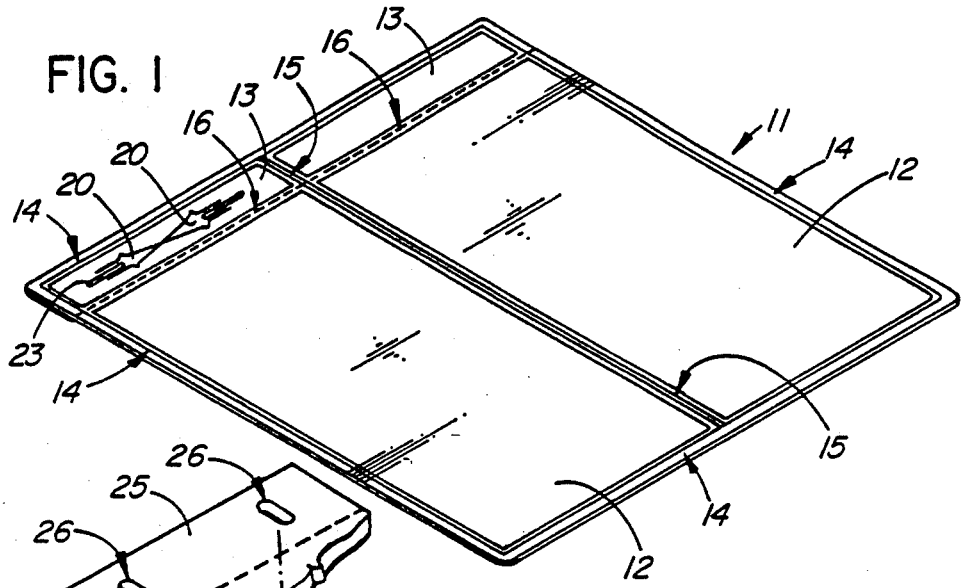
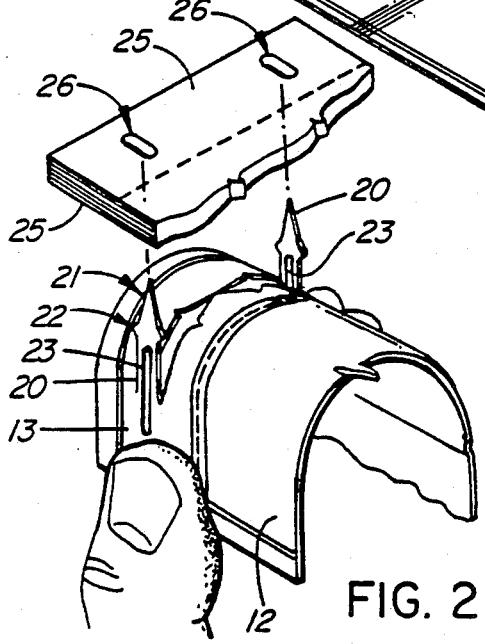
FIG. 2
FIG. 3
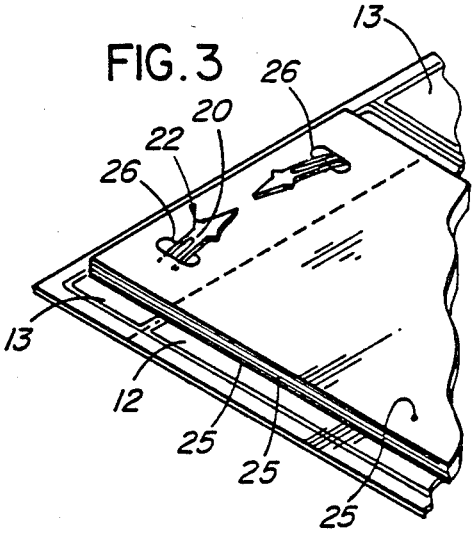
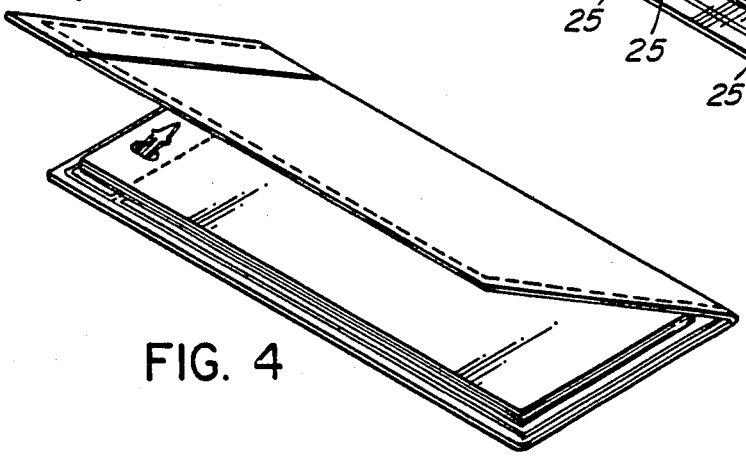
FIG. 4

HOLDING ELEMENT FOR SHEETS OF PAPER AND SIMILAR MATERIALS

This invention relates to a holding element for holding a sheet or sheets of paper or similar material, and in particular, to that type of holding element having integral prongs formed therein adapted to extend through apertures in the sheet or sheets.

It is well known to retain loose-leaf pages on closable O-rings or in a binder having a series of closable rings on its spine. Also, deformable clips have been utilized for retaining sheets of paper on a heavy backing, each clip being an elongated member which has a central portion extending adjacent to one side of the backing and its end portions extending through the backing and through the sheets of paper, each of the ends being deformable to retain the sheets of paper against the backing. Usually, with the elongated clip-type of retention system a metal or plastic bar is placed across the opposite face of the sheets of paper from the backing and the ends of the deformable clip extend through apertures in the bar and are deformed to rest against the surface of the bar. The sheets of paper are then retained between the backing and the bar.

The subject invention is a one-piece holding element for holding at least one sheet of paper or similar material thereon, the at least one sheet having a pair of apertures therein of selected size and separation distance. In one form, the holding element has a generally sheet-like body and has a pair of prong-like members cut therein such that each member remains integrally attached by one of its ends to the remainder of the holding element. Each member is adapted to extend through a respective aperture in the at least one sheet of paper or similar material. Each prong-like member has a stem portion and an outer other end portion of larger size than the stem portion, the apertures in the at least one sheet each being of slightly larger size one sheet of paper or similar material, the pair of apertures having a separation distance therebetween generally the same as that between the one ends of the prong-like members. Each prong-like member has a stem portion and an outer other end portion of larger size than the stem portion, the apertures in the at least one sheet each being of slightly larger size than the size of the stem-portion of the prong-like members, but of slightly smaller size than the size of the outer end portions. The outer end portion of each prong-like member can be forced through a respective one of the apertures in the at least one sheet of paper or similar material to hold that sheet on the holding element.

In a second form of the holding element of the subject invention the holding element is formed from a resilient material having a generally planar configuration and having a pair of prong-like members cut therein, the prong-like members extending generally parallel to each other. Each prong-like member remains integrally attached by one of its ends to the remainder of the holding element, the remainder of the holding element being adapted to arcuately flex under bias around an axis extending normal to the longitudinal axis of the prong-like members to extend those members out of the arcuate surface of the remainder of the holding element. The prong-like members are cut in the holding element such that the members point either toward each other or away from each other. In this form of the invention, the separation distance between the one ends of the prong-like members is generally the same as the separation distance between the apertures in the at least one sheet of paper or similar material. When the remainder of the holding element is flexed such that the prong-like members extend out of the arcuate surface of the remainder of the holding element each of the prong-like members can be extended through a respective one of the apertures in the at least one sheet. After release of the bias, the prong-like members act to return to the plane of the remainder of the holding element and thereby hold the at least one sheet against the remainder of the holding element.

The second form of the subject invention may be modified such that each prong-like member has a stem portion and an outer other end portion of larger size than the stem portion. Also, in the modified form the apertures in the at least one sheet of paper or similar material are of a slightly larger size than the size of the stem portion of the prong-like members but of slightly smaller size than the size of the outer end portions. When the holding element is flexed under bias such that the prong-like members arcuate surface of the remainder of the holding element for inserting thereon the at least one sheet, the outer end portion of each prong-like member can be forced through a respective one of the apertures in the at least one sheet to improve the retention of the at least one sheet on the holding element after release of the bias.

The holding element in the second form of the invention may be formed from a resilient plastic which acts to retain the prong-like members in the plane of the remainder of the holding element. A pair of ridges may be formed in the holding element, each ridge extending longitudinally along a respective one of the prong-like members and into the remainder of the holding element at the respective one end of the prong-like member. The pair of ridges provide rigidity to the prong-like members and improve the ability of the prong-like members to return to the plane of the remainder of the holding element after release of the bias.

The holding element may be a backing adapted to hold blank cheques, and the at least one sheet of paper or similar material may be at least one blank cheque.

The subject invention will now be more fully described in terms of a preferred embodiment utilizing the accompanying drawing, in which:

FIG. 1 is a perspective view of one embodiment of the planar holdng element of the subject invention;

FIG. 2 is a partial perspective view of the holding element of FIG. 1 and a plurality of sheets adapted to be retained on that holding element, the remainder of the holding element being flexed by bias such that the prong-like members of the holding element extend out of the arcuate surface of the remainder of the holding element;

FIG. 3 is a partial perspective view of the holding element of FIG. 1 and a plurality of sheets retained on that holding element after removal of the flexure bias;

FIG. 4 is a perspective view of the holding element of FIG. 1 and a plurality of sheets retained on that holding element, the holding element being folded to enclose the plurality of sheets.

FIG. 1 illustrates a plastic backing generally designated as 11, that backing being adapted to retain blank cheques. The backing 11 is formed from plastic sheeting, and has a pair of panels 12 integrally connected to each other and to a second pair of panels 13 as shown in FIG. 1. For reasons that will subsequently become clear, the pair of panels 13 are of greater thickness than the pair of panels 12. An embossed border 14 extends around the periphery of backing 11, and a similar embossment 15 extends between each of the panels 12 and each of the panels 13. Similarly, an embossment 16 separates each of the panels 12 from each of the panels 13.

With the backing 11 vertically oriented such that the pair of panels 12 are positioned to the right of the pair of panels 13, the lower panel 13 has a pair of prong-like members 20 cut therein. The members 20 can be cut in the panel 13 by, for instance, a stamping die. As shown in FIG. 2, each prong-like member 20 is cut in the one panel 13 such that its one end remains integrally connected with the remainder of that panel 13. The other end 21 of each prong-like member 20 is pointed, and a pair of shoulders 22 extend laterally from opposite sides of prong-like member 20 adjacent to the pointed end 21. As shown in FIG. 1, the prong-like members 20 are stamped in the panel 13 such that the longitudinal axes of the members when in the plane of the remainder of panel 13 are in parallel alignment, the pointed ends 21 of the members being generally directed toward each other. The reason for the panels 13 being formed of a plastic of greater thickness than panels 12 is to provide sufficient resiliency in panel 13 such that each of the prong-like members 20 acts to remain in the plane of the remainder of that panel. FIG. 2 illustrates the application of flexure bias to one half of backing 11 such that prong-like members 20 extend out of the arcuate surface of the remainder of that panel 13. The one end of each prong-like member 20 extends generally tangential to the respective adjacent portion of the surface of the remainder of the panel 13. A pair of ridges 23 are formed in the panel 13, each ridge 23 extending longitudinally along a respective one of the prong-like members 20 and the adjacent surface of the panel 13. Each ridge 23 provides rigidity to the respective prong-like member 20 and improves the ability of that member to return to the plane of the remainder of the holding element after release of the flexure bias.

As shown in FIG. 3, a plurality of blank cheques 25, each having a pair of apertures 26 along one of their shorter ends, can be positioned on backing 11 such that one of the prong-like members 20 extends through one of the apertures 26. As previously described, a bias force is applied to flex one half of backing 11 such that each of the prong-like members 20 extend out of the resulting arcuate surface of the remainder of panel 13 prior to placement of the plurality of blank cheques 25 thereon. Once the blank cheques 25 have been positioned on to members 20 and the bias force removed, members 20 attempt to return to the plane of the remainder of panel 13 and the plurality of blank cheques 25 are thereby retained on backing 11. The pointed outer ends 21 of members 20 rest against the outer surface of the outermost one of the blank cheques 25. 21 of members 20 rest against the outer surface of the outer blank cheque 25.

The presence of the pair of shoulders 22 on each prong-like member 20 is not necessary for the retention of the blank cheques 25 on backing 11 in the previously-described embodiment. Therefore, with reference to FIG. 3, the relative size of each aperture 26 and the distance across a pair of shoulders 22 of each prong-like member 20 are not critical although it should be obvious that each aperture 26 should be sized larger than the stem portion of each member 20. However, increased security for retention of blank cheques 25 on backing 11 is obtained by sizing each aperture 26 smaller than the distance across the shoulders 22 of each member 20. It should be evident also that the prong-like members 20 could be cut in panel 13 such that the outer pointed ends 21 of members 20 are directed away from each other rather than being directed toward each other. In such case and with reference to FIG. 3, the members 20 would each point towards a longer edge of each blank 25 rather than toward each other and away from that edge as shown in FIG. 3.

Another embodiment (not illustrated) of the subject invention has a backing with a panel 13 of reduced thickness. Each of the prong-like members freely flex out of the plane of the remainder of panel 13 and need not necessarily be in longitudinal alignment. However, this embodiment would require that the prong-like members each have a pair of shoulders proximate of their pointed outer ends and that the distance across those shoulders be greater than the size of the apertures on the blank cheques. In this embodiment and unlike the previously-described embodiment, only the shoulders 22 on each prong-like member 20 would act to retain the plurality of blank cheques 25 on backing 11. In this embodiment it would not be necessary for the prong-like members 20 to act to remain in the plane of the remainder of panel 13, nor would it be necessary for members 20 to be cut from panel 13 in a configuration such that their longitudinal axes extend in generally parallel alignment.

I claim:

1. A plastic resilient holding element adapted to hold a series of sheets of paper or similar material thereon, the sheets each having a pair of apertures therein of selected size and separation distance, the holding element having a generally planar configuration and having a pair of prong-like members cut therein, the prong-like members extending generally in-line with each other such that the members point generally toward each other, each prong-like member being integrally attached by one of its ends to the remainder of the holding element without diminution at the point of attachment, the remainder of the holding element being adapted to arcuately flex under bias around an axis extending normal to the longitudinal axis of the prong-like members to extend those members out of the arcuate surface of the remainder of the holding element, the separation distance between the one ends of the prong-like members being generally the same as the separation distance between the apertures in the sheets of paper or similar material, whereby when the holding element is flexed such that the prong-like members extend out of the arcuate surface of the remainder of the holding element each of the prong-like members can be extended through a respective one of the apertures in the sheets, the prong-like members after release of the bias acting to return to the plane of the remainder of the holding element and thereby holding the sheets against the remainder of the holding element.

2. A holding element as in claim 1, wherein each prong-like member has a stem portion and an outer other end portion of larger size than the stem portion, and wherein the apertures in the sheets of paper or similar material are of a slightly larger size than the size of the stem portion of the prong-like members but of slightly smaller size than the size of the outer end portions, whereby when the holding element is flexed under bias such that the prong-like members extend out of the arcuate surface of the remainder of the holding element for insertion thereon of the sheets, the outer end portion of each prong-like member can be forced through a respective one of the apertures in the sheets to improve the retention of the sheets on the holding element after release of the bias.

3. A holding element as in claim 1 or 2 in combination with the series of sheets of paper or similar material.

4. A holding element as in claim 1 or 2, wherein a pair of ridges are formed in each holding element, each ridge extending longitudinally along a respective one of the prong-like members and into the remainder of the holding element at the one end of the prong-like member, the pair of ridges providing rigidity to the prong-like members and improving the ability of the prong-like members to return to the plane of the remainder of the holding element after release of the bias.

5. A holding element as in claim 1 or 2 wherein the holding element forms at least a portion of a backing adapted to hold blank cheques, and wherein the sheets of paper or similar material are blank cheques.

6. A plastic resilient holding element adapted to hold a series of sheets of paper or similar material thereon, the sheets each having a pair of apertures therein of selected size and separation distance, the holding element having a generally planar configuration and having a pair of prong-like members cut therein, the prong-like members extending generally in-line with each other such that the members point generally away from each other, each prong-like member being integrally attached by one of its ends to the remainder of the holding element without diminution at the point of attachment, the prong-like members being adapted to flex under bias out of the surface of the remainder of the holding element, the flexure of each prong-like member being around an axis extending normal to the longitudinal axis of the prong-like members, the separation distance between the one ends of the prong-like members being generally the same as the separation distance between the apertures in the sheets of paper or similar material, whereby each of the prong-like members can be extended through a respective one of the apertures in the series of sheets and whereby, after release of the bias, the prong-like members act to return to the plane of the remainder of the holding element and thereby hold the series of sheets against the remainder of the holding element.

* * * * *